United States Patent [19]

Sorenson

[11] Patent Number: 4,603,750

[45] Date of Patent: Aug. 5, 1986

[54] REPLACEABLE BIT NOZZLE

[75] Inventor: Robert B. Sorenson, Houston, Tex.

[73] Assignee: Hughes Tool Company - USA, Houston, Tex.

[21] Appl. No.: 656,825

[22] Filed: Oct. 2, 1984

[51] Int. Cl.[4] ..... E21B 10/60

[52] U.S. Cl. ..... 175/340; 175/393; 175/422 R

[58] Field of Search ..... 175/339, 340, 393, 422

[56] References Cited

U.S. PATENT DOCUMENTS

| | | | |
|---|---|---|---|
| 2,108,955 | 2/1938 | Zublin | 175/340 X |
| 2,201,569 | 5/1940 | Zublin | 255/71 |
| 2,884,227 | 4/1959 | Hjalsten | 175/393 X |
| 3,220,754 | 11/1965 | Mori | 285/305 |
| 3,336,614 | 8/1967 | Benjamin | 10/141 |
| 3,645,346 | 2/1972 | Miller et al. | 175/340 X |
| 4,193,463 | 3/1980 | Evans | 175/337 |
| 4,301,877 | 11/1981 | Cloud | 175/340 |
| 4,306,627 | 12/1981 | Cheung et al. | 175/422 |
| 4,381,825 | 5/1983 | Radtke | 175/393 |
| 4,400,024 | 8/1983 | Ratcliff et al. | 285/356 |
| 4,499,958 | 2/1985 | Radtke et al. | 175/410 X |

*Primary Examiner*—S. Levy
*Assistant Examiner*—David Werner
*Attorney, Agent, or Firm*—James E. Bradley

[57] ABSTRACT

A drilling fluid nozzle for an earth boring bit is formed entirely of tungsten carbide, having hard-ground threads on its exterior for securing in the bit passage. The nozzle has an upwardly facing shoulder located below the threads which sealingly engages a downwardly facing shoulder formed in the bit passage. An O-ring seal is located above the threads.

4 Claims, 2 Drawing Figures

REPLACEABLE BIT NOZZLE

BACKGROUND OF THE INVENTION

1. Field of the Invention:

This invention relates in general to earth boring bits, and in particular to a replaceable tungsten carbide nozzle for use in earth boring bits.

2. Description of the Prior Art:

An earth boring bit of the type concerned herein has a body with a threaded pin on its upper end for connection to a string of drill pipe extending to the surface. The bit has a cutting face on its lower end, which is an integral part of the body. Polycrystalline diamond (PDC) disks are mounted on the face. Normally there are several passages extending through the body for discharging drilling fluid pumped down the drill string. Nozzles are located at the outlets of the passages. The nozzle is normally of tungsten carbide to resist erosion.

Drill bit nozzles have been retained in many different manners. In rolling cutter bits, the nozzles are normally retained by snap rings. In the PDC type bit, it is desirable to have easily replaceable nozzles. An easily replaceable nozzle allows the personnel in the field to change the size of the nozzles for different bit hydraulics, even after the bit has drilled on prior occasions. PDC bits are often used for drilling specified intervals and may be reused on different wells. Some ring retained nozzles cannot be replaced, because the ring is recessed to prevent erosion. Many PDC type bits use a separate steel threaded nut located below the nozzle for retaining the nozzle in the passage. In U.S. Pat. No. 4,381,825, Radtke, May 3, 1983, the nozzle has a steel sleeve brazed onto the tungsten carbide body of the nozzle to allow the nozzle to be secured by threads into the bit passage.

SUMMARY OF THE INVENTION

In this invention, the nozzle is formed entirely of tungsten carbide, and has threads formed on the exterior of the nozzle. The nozzle has a lower section and an upper section of smaller diameter. This results in an upwardly facing shoulder which sealingly engages a downwardly facing shoulder formed in the bit passage. The threads are located in the upper section. An elastomeric seal ring surrounds the nozzle upper section above the threads to prevent entry from above of drilling fluid into the threaded section. The sealing engagement of the lower shoulders prevent entry of drilling fluid from below into the threaded section. The nozzle has an extra long nose section to reduce the chances of cross-threading, and to allow oversize O-rings.

DESCRIPTION OF THE PREFERRED EMBODIMENT

Figure 1:
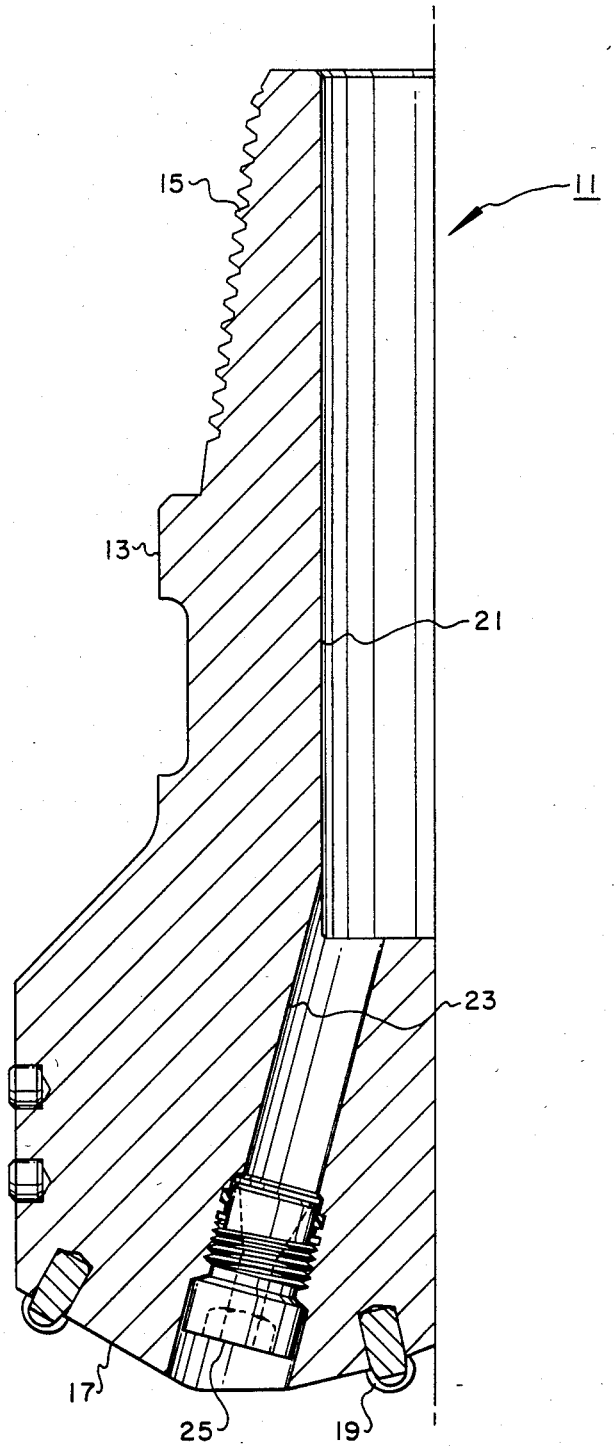
FIG. 1 is a quarter sectional view of an earth boring bit having a nozzle constructed in accordance with this invention.

Referring to FIG. 1, earth boring bit 11 is of a solid head type. Bit 11 has a steel body 13 with a threaded pin 15 on its upper end for connection to a string (not shown) of drill pipe. A cutting face 17 is located on the lower end. A plurality of cutting elements 19 are secured within holes formed in the cutting face 17. The cutting elements 19 in the embodiment shown in FIG. 1 are of the polycrystalline diamond (PDC) disk type. An axial passage 21 extends longitudinally into the body 13 from the upper end. There are several (only one shown) nozzle passages 23 that extend from the axial passage 21 to the face 17 for discharging drilling fluid into the wellbore. A nozzle 25 is located at the outlet of each nozzle passage 23.

Figure 2:
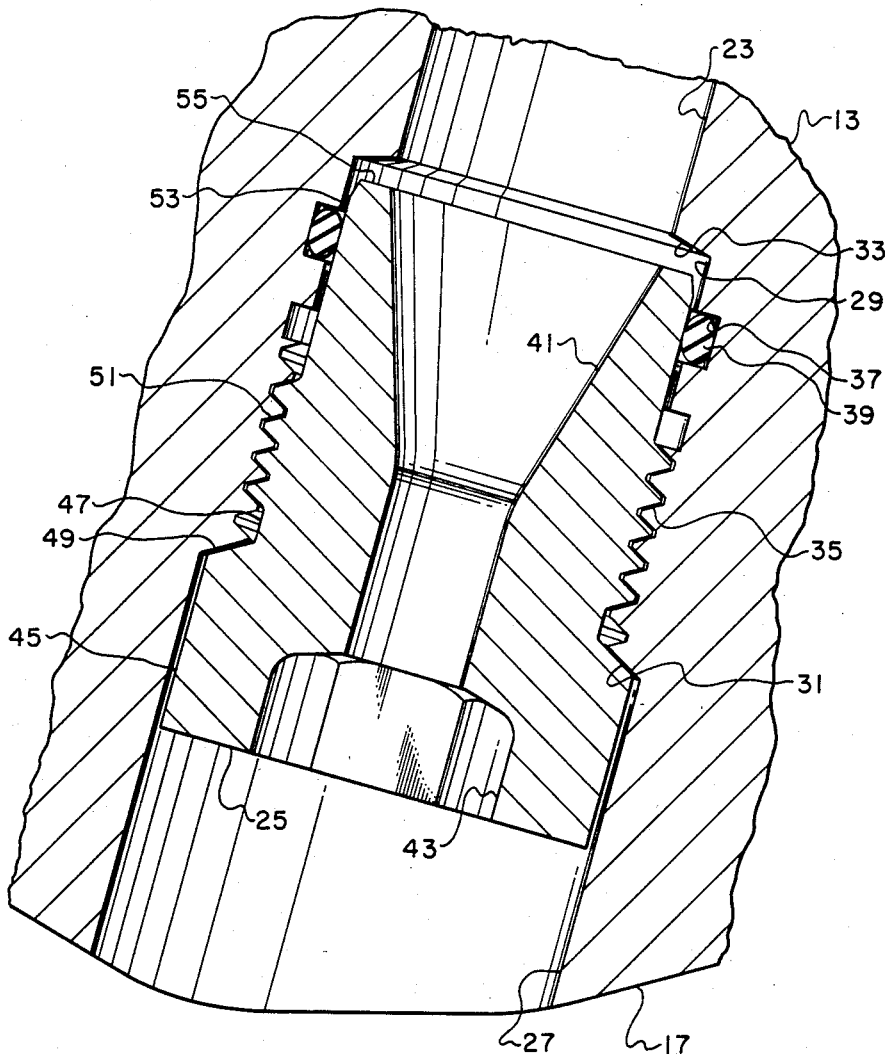
FIG. 2 is an enlarged partial sectional view of the nozzle of FIG. 1.

Referring to FIG. 2, each nozzle passage 23 has a lower counterbore section 27 that extends to the face 17. The lower counterbore section 27 joins an upper counterbore section 29 of smaller diameter, resulting in a lower shoulder 31 located between the upper and lower counterbore sections 27 and 29. Lower shoulder 31 faces downwardly and is beveled. Preferably, it is a frusto-conical surface formed at an angle of 30 degrees with respect to a line drawn perpendicular to the axis of nozzle passage 23. An upper shoulder 33 is located at the upper end of the upper counterbore section 29. Upper shoulder 33 faces downwardly and is also beveled. It is preferably formed at an angle of 15 degrees with respect to a line drawn perpendicular to the axis of the nozzle passage 23.

A section of threads 35 are formed in the upper counterbore section 29. The lower end of the threads 35 begins a short distance above the lower shoulder 31. The upper end of the threads 35 terminates a considerable distance from the upper shoulder 33. A groove 37 is formed above the threads 35 in the upper counterbore section 29. Groove 37 is adapted to receive a conventional O-ring 39.

Nozzle 25 is formed entirely of tungsten carbide. Nozzle 25 has an axial passage 41 formed therethrough for the passage of drilling fluid pumped down the bit passages 21 and 23. Passage 41 converges into a polygonal six-sided socket 43 at the lower end of the nozzle 25. Socket 43 is adapted to receive a wrench (not shown) for tightening and loosening the nozzle 25. Nozzle 25 has a cylindrical lower section 45 that is enlarged for reception within the lower counterbore section 27. Socket 43 is located in the lower section 45. A small annular clearance exists between the lower section 45 and the lower counterbore section 27 to facilitate the insertion and removal of the nozzle 25. Nozzle 25 has an upper section 47 that is of smaller diameter than the lower section 45. This defines a shoulder 49 between the lower and upper sections 45 and 47. Shoulder 49 is beveled at the same angle as the passage lower shoulder 31 to form a metal-to-metal seal between the two surfaces.

A set of threads 51 are formed on the exterior of the nozzle upper section 47. Threads 51 are formed in the exterior of the upper section 47 by grinding after the tungsten carbide nozzle has been sintered. A nose section 53 extends from the upper end of threads 51 to the upper end 55. Nose section 53 has a smooth cylindrical exterior for sealing against the O-ring 39. The nose section 53 preferably has a length from the uppermost thread 51 to the upper end 55 that is greater than one-half the diameter of the nozzle 25. The length of the nose section 53 in the preferred embodiment is approximately 40% of the total distance from upper end 55 to the periphery of shoulder 49. The upper end 55 of nozzle 25 is spaced below the upper shoulder 33 a short distance when the nozzle 25 is fully made up. The clearance between upper end 55 and shoulder 33 should be enough to assure that under no conditions will they contact each other. Preferably the clearance is nominally 0.062 inch.

In operation, the nozzle 25 is secured to the bit 11 by using a wrench (not shown). The passage threads 35 should first be lightly greased, with any excess grease removed from the lower shoulder 31 and first thread 35. A thread cleaner should be sprayed on the lower shoulder 31 and first thread 35 or more. The preferred thread cleaner is "Loctite primer N". A thread sealant, preferably "Loctite No. 242" should be applied to the nozzle shoulder 49 and the first adjacent thread 51. The nozzle 25 is screwed into the passage 23 with the wrench to about 100 foot pounds torque. A clearance will exist between the nozzle upper end 55 and the upper shoulder 33 when fully made up.

During drilling, drilling fluid will be discharged through the passages 21, 23 and 41. O-ring 39 will prevent the entry from above of drilling fluid into the threaded sections 35 and 51. The metal-to-metal seal formed by the shoulders 31 and 49 will prevent the entry of drilling fluid from below into the threaded sections 35 and 51. After drilling, if it is desired to replace the nozzle 25 with another nozzle for further drilling, the nozzle 25 is removed with the same wrench applying about 125 to 150 foot pounds of torque.

The invention has significant advantages. The solid, one piece nozzle provides a replaceable nozzle without the need for an additional retaining nut. Also, hard grinding the threads in the tungsten carbide avoids the need for brazing on a metal sleeve. This avoids the risk of the sleeve shearing from the nozzle body. Providing a clearance at the upper end of the nozzle assures that the lower shoulders will make up to form a tight metal-to-metal seal to avoid entry of drilling fluid into the threaded area from below. If drilling fluid entered the threads, it might be difficult or impossible to remove the nozzle. The long nose section facilitates the assembly of the nozzle in the passage, reducing the chance for cross-threading. The long nose section also enables the manufacturer to enlarge the O-ring groove and place a larger O-ring therein if the original groove was defectively formed. This avoids having to scrap the entire bit head.

While the invention has been shown in only one of its forms, it should be apparent to those skilled in the art that it is not so limited but is susceptible to various changes without departing from the scope of the invention.

I claim:

1. In an earth boring bit having at least one passage for discharging drilling fluid, the improvement comprising in combination:

a lower counterbore section in the nozzle passage extending from the lower end of the passage upwardly, terminating in a downwardly facing lower shoulder;

an upper counterbore section in the passage extending upwardly from the lower shoulder and terminating in a downwardly facing upper shoulder;

a threaded section formed in the upper counterbore section, having its upper end spaced below the upper shoulder a selected distance;

a nozzle having an enlarged lower section for reception in the lower counterbore section and an upper section of smaller diameter for reception in the upper counterbore section, defining an upwardly facing shoulder for sealing engagement with the lower shoulder formed in the bit passage;

the upper section having a threaded section for securing the nozzle to the threaded section formed in the bit passage; and elastomeric seal means surrounding the nozzle upper section above the threaded section for preventing the entry from above of drilling fluid into the theaded section;

the sealing engagement of the nozzle shoulder with the lower shoulder preventing entry of drilling fluid from below into the threaded section;

the length of the nozzle upper section being selected so that a clearance exists between the upper end of the nozzle and the upper shoulder when the nozzle is fully made up, assuring sealing contact of the nozzle shoulder with the lower shoulder.

2. An improved earth boring bit, comprising in combination:

a body having a pin on its upper end for connection to a string of drill pipe, and a cutting face on its lower end containing cutting elements for disintegrating earth formations;

at least one passage extending through the body for discharging drilling fluid pumped down the drill string;

a lower counterbore section in the nozzle passage extending from the lower end of the passage upwardly, terminating in a downwardly facing frusto-conical lower shoulder;

an upper counterbore section in the passage extending upwardly from the frusto-conical lower shoulder and terminating in a downwardly facing upper shoulder;

a threaded section formed in the upper counterbore section, having its upper end spaced below the upper shoulder a selected distance;

an O-ring seal located in a groove formed in the upper counterbore section between the threaded section and the upper section;

a nozzle having an enlarged lower section for reception in the lower counterbore section, and an upper section for reception in the upper counterbore section, the nozzle having a frusto-conical upwardly facing shoulder between the upper and lower sections for metal-to-metal sealing engagement with the lower shoulder of the passage;

a threaded section on the upper section of the nozzle for threaded engagement with the threaded section of the upper counterbore section;

a cylindrical nose section formed on the nozzle upper section for sealing engagement with the O-ring seal to prevent entry of drilling fluid from above into the threaded sections;

the length of the nozzle upper section being selected so that a clearance exists between the upper end of the nozzle and the upper shoulder when the nozzle is fully made up, assuring sealing contact of the frusto-conical shoulders to prevent entry of drilling fluid from below in to the threaded sections.

3. An improved earth boring bit, comprising in combination:

a body having a pin on its upper end for connection to a string of drill pipe, and a cutting face on its lower end containing cutting elements for disintegrating earth formations;

at least one passage extending through the body for discharging drilling fluid pumped down the drill string;

a lower counterbore section in the nozzle passage extending from the lower end of the passage upwardly, terminating in a downwardly facing frusto-conical lower shoulder;

an upper counterbore section in the passage extending upwardly from the frusto-conical lower shoulder and terminating in a downwardly facing upper shoulder;

a threaded section formed in the upper counterbore section, having its upper end spaced below the upper shoulder a selected distance;

an O-ring seal located in a groove formed in the upper counterbore section between the threaded section and the upper section;

a nozzle formed entirely of tungsten carbide having an enlarged lower section for reception in the lower counterbore section, and an upper section for reception in the upper counterbore section, the nozzle having a frusto-conical upwardly facing shoulder between the upper and lower sections for metal-to-metal sealing engagement with the lower shoulder of the passage;

a threaded section on the upper section of the nozzle for threaded engagement with the threaded section of the upper counterbore section;

a cylindrical nose section formed on the nozzle upper section for sealing engagement with the O-ring seal to prevent entry of drilling fluid from above into the threaded sections;

the length of the nozzle upper section being selected so that a clearance exists between the upper end of the nozzle and the upper shoulder when the nozzle is fully made up, assuring sealing contact of the frustoconical shoulders to prevent entry of drilling fluid from below into the threaded sections.

4. An improved earth boring bit, comprising in combination:

a body having a pin on its upper end for connection to a string of drill pipe, and a cutting face on its lower end containing cutting elements for disintegrating earth formations;

at least one passage extending through the body for discharging drilling fluid pumped down the drill string;

a lower counterbore section in the nozzle passage extending from the lower end of the passage upwardly, terminating in a downwardly facing frusto-conical lower shoulder;

an upper counterbore section in the passage extending upwardly from the frusto-conical lower shoulder and terminating in a downwardly facing upper shoulder;

a threaded section formed in the upper counterbore section, having its upper end spaced below the upper shoulder a selected distance;

an O-ring seal located in a groove formed in the upper counterbore section between the threaded section and the upper section;

a nozzle having an enlarged lower section for reception in the lower counterbore section, and an upper section for reception in the upper counterbore section, the nozzle having a frusto-conical upwardly facing shoulder between the upper and lower sections for metalto-metal sealing engagement with the lower shoulder of the passage;

a threaded section on the upper section of the nozzle for threaded engagement with the threaded section of the upper counterbore section;

a cylindrical nose section formed on the nozzle upper section for sealing engagement with the O-ring seal to prevent entry of drilling fluid from above into the threaded sections, the nose section having a length at least one-half its diameter;

the length of the nozzle upper section being selected so that a clearance exists between the upper end of the nozzle and the upper shoulder when the nozzle is fully made up, assuring sealing contact of the frustoconical shoulders to prevent entry of drilling fluid from below in to the threaded sections.

* * * * *